US009362622B2

(12) United States Patent
Thomas

(10) Patent No.: US 9,362,622 B2
(45) Date of Patent: Jun. 7, 2016

(54) HIGH-FREQUENCY ANTENNA

(75) Inventor: Thierry Thomas, Varces Allieres et Risset (FR)

(73) Assignee: Commissariat à l'énergie atomique aux énergies alternatives (FR)

( * ) Notice: Subject to any disclaimer, the term of this patent is extended or adjusted under 35 U.S.C. 154(b) by 563 days.

(21) Appl. No.: 13/704,566

(22) PCT Filed: Jun. 14, 2011

(86) PCT No.: PCT/FR2011/051346
§ 371 (c)(1),
(2), (4) Date: Feb. 27, 2013

(87) PCT Pub. No.: WO2011/157942
PCT Pub. Date: Dec. 22, 2011

(65) Prior Publication Data

US 2013/0207857 A1 Aug. 15, 2013

(30) Foreign Application Priority Data

Jun. 15, 2010 (FR) ..... 10 54724

(51) Int. Cl.
*H01Q 11/12* (2006.01)
*H01Q 7/00* (2006.01)
(Continued)

(52) U.S. Cl.
CPC . *H01Q 7/00* (2013.01); *H01Q 7/04* (2013.01); *H01Q 21/10* (2013.01)

(58) Field of Classification Search
CPC ..... H01Q 7/00
USPC ..... 343/741
See application file for complete search history.

(56) References Cited

U.S. PATENT DOCUMENTS 5,258,766 A 11/1993 Murdoch
6,771,227 B2 * 8/2004 Tsai et al. ..... 343/801
(Continued)

FOREIGN PATENT DOCUMENTS

CN 1190496 A 8/1998
CN 1359167 A 7/2002
(Continued)

OTHER PUBLICATIONS

Paul H. Duncan, "Analysis of The Moebius Loop Magnetic Field Sensor", "IEEE Transactions on Electromagnetic Compatibility", May 1, 1974, pp. 83-89, vol. EMC-10, No. 2, Publisher: IEEE, Published in: New York, US, XP11164638A.
(Continued)

*Primary Examiner* — Graham Smith
(74) *Attorney, Agent, or Firm* — Kaplan Breyer Schwarz & Ottesen, LLP

(57) ABSTRACT

The invention relates to an inductive antenna formed from at least two pairs of segments (32, 34) geometrically butted together and each comprising first (322, 342) and second (324, 344) parallel conductors insulated from each other, each pair having, at each end, a single terminal for the electrical connection of its first conductor to that of the neighboring pair, in which said pairs are of a first type (3), in which the conductors are interrupted approximately at their mid-points so as to define the two segments, the first (respectively second) conductor of one segment being connected to the second (respectively first) conductor of the other segment of the pair, or of a second type, in which the first conductor is interrupted approximately at its mid-point so as to define the two segments, the second conductor not being interrupted.

14 Claims, 4 Drawing Sheets

(51) Int. Cl.
*H01Q 7/04* (2006.01)
*H01Q 21/10* (2006.01)

(56) References Cited

U.S. PATENT DOCUMENTS

| | | | |
|---|---|---|---|
| 6,847,210 | B1 | 1/2005 | Eydelman et al. |
| 2003/0080918 | A1 | 5/2003 | Forster et al. |
| 2003/0231020 | A1 | 12/2003 | Yonezawa et al. |
| 2013/0271343 | A1 | 10/2013 | Thomas |

FOREIGN PATENT DOCUMENTS

| | | | |
|---|---|---|---|
| CN | 101582537 | A | 11/2009 |
| DE | 3140319 | A1 | 4/1983 |
| EP | 1675212 | | 6/2006 |
| JP | S4415243 | Y1 | 7/1969 |
| JP | 2004336198 | A | 11/2004 |
| WO | 2005029633 | A1 | 3/2005 |
| WO | 2007084510 | A1 | 7/2007 |
| WO | 2008083719 | A1 | 7/2008 |

OTHER PUBLICATIONS

Peter Kruck, "International Application No. PCT/FR2011/051346 Search Report", Sep. 19, 2011.
"Corresponding Chinese Patent Application No. 201180039130.0 Office Action ", Apr. 3, 2014, Publisher: CIPO, Published in: CN.
International Searching Authority, "International Patent Application: PCT/FR2011/051346 Written Opinion of the ISA", , Publisher: PCT, Published in: FR.
First Office Action, issued in related Chinese Application No. 2011-80038901.4, (counterpart of related U.S. Appl. No. 13/704,576, dated May 4, 2015.
Notice of Allowance dated Nov. 3, 2015, issued in related U.S. Appl. No. 13/704,576.
Non-Final Office Action dated Jul. 2, 2015, issued in related U.S. Appl. No. 13/704,576.
International Search Report, dated Oct. 7, 2011, issued in related International Application No. PCT/FR2011/051345 (counterpart of related U.S. Appl. No. 13/704,576).
Garcia-Garcia, et al, "On the resonances and polarizabilities of split ring resonators", "Journal of Applied Physics", Aug. 10, 2005, pp. 1-9, vol. 98, No. 033103, Publisher: American Institute of Physics; DOI: 10.1063/1.2006224; XP-12078207A, Published in: US.

* cited by examiner

HIGH-FREQUENCY ANTENNA

FIELD OF THE INVENTION

The present invention generally relates to antennas and, more specifically, to the forming of a high-frequency inductive antenna.

The invention more specifically applies to antennas intended for radio frequency transmissions of several MHz, for example, for contactless chip card, RFID tag, or electromagnetic transponder transmission systems.

DISCUSSION OF THE RELATED ART

FIG. 1 very schematically shows an example of an inductive-type transmission system of the type to which the present invention applies as an example.

Such a system comprises a reader or base station 1 generating an electromagnetic field capable of being detected by one or several transponders 2 located in its field. Such transponders 2 are, for example, an electronic tag 2' placed on an object for identification purposes, a contactless smart card 2", or more generally any electromagnetic transponder (symbolized by a block 2 in FIG. 1).

On the side of reader 1, a series resonant circuit is formed of a resistor r, of a capacitor C1, and of an inductive element L1 or antenna. This circuit is excited by a high-frequency generator 12 (HF) controlled (connection 14) by other circuits, not shown, of base station 1. A high-frequency carrier is generally modulated (in amplitude and/or in phase) to transmit data to the transponder.

On the side of transponder 2, a resonant circuit, generally parallel, comprises an inductive element or antenna L2 in parallel with a capacitor C2 and with a load R representing electronic circuits 22 of transponder 2. This resonant circuit, when in the field of the reader, detects the high-frequency signal transmitted by the base station. In the case of a contactless card, such circuits symbolized by a block 22 comprising one or several chips are connected to an antenna L2 generally supported by the card support. In the case of an electronic tag 2', inductive element L2 is formed of a conductive winding connected to an electronic chip 22.

Although the symbolic representation in the form of a series resonant circuit on the base station side and of a parallel resonant circuit on the transponder side is usual, in practice, one may find series resonant circuits on the transponder side and parallel resonant circuits on the base station side.

The resonant circuits of the reader and of the transponder are generally tuned to a same resonance frequency ω ($L1.C1.\omega^2=L2.C2.\omega^2=1$).

Transponders generally have no autonomous power supply and draw the power necessary to their operation from the magnetic field generated by base station 1.

According to another example of application, the base station is used to recharge a battery or another power storage element of the transponder. The high-frequency field radiated by the base station is then not necessarily modulated to transmit data.

In an inductive antenna, the conductive circuit most often is a closed circuit conducting the current intended to generate the radio frequency magnetic field. The closed conductive circuit is powered by radio frequency generator 12.

When the antenna size becomes significant with respect to the wavelength, the circulation of the current intended to generate the magnetic field along the conductor becomes more difficult. The amplitude and the phase of the current have strong variations along the circuit, which no longer enable the antenna to operate in inductive loop. It is further often desirable to have, on the base station side, an antenna of large size as compared with the size of the transponder antenna. Indeed, transponders are generally in motion (supported by a user) when presented to a base station and it is desirable for them to be able to detect the field even during this motion. In other cases, it is desired for the size of the area where the communication with a transponder is possible to be significant. On the other hand, it is advantageous to use a large inductive loop to provide a wide communication range.

Now, the longer the conductive circuit of the antenna, the higher its inductance L, and the lower the value of the capacitor to be associated with the antenna. As a result, in large antennas, the capacitance value may be of the same order as the stray capacitances present between the different portions of the conductive circuits and as the stray capacitances capable of being introduced into the system (for example, by a user's hand), which disturbs the operation.

The longer the conductive circuit of the inductive antenna, the more the current circulation along the circuit is different from that which is desired. There thus is a significant amplitude and phase variation of the current along the circuit, which modifies and disturbs the space distribution of the generated magnetic field. There also is an increase of electric potentials between different portions of the conductive circuit, which makes the behavior of the antenna sensitive to the presence of dielectric materials in its close environment.

The inductive loop length is thus conventionally limited.

It has already been provided to split the conductive loop into elements individually having the same length, and to reconnect these elements with capacitors to enable to use a large loop. Such a solution is for example described in patent U.S. Pat. No. 5,258,766.

It has also already been provided to use shielded inductive loops with a shielding interruption and a conductor inversion. Such loops are generally called "Moebius loops". Such structures are for example described in article "Analysis of the Moebius Loop Magnetic Field Sensor" by P. H. Duncan, published IEEE Transaction on Electromagnetic Compatibility, May 1974. Such structures however still have a limited length.

There thus is a need for the forming of a large inductive antenna.

SUMMARY

An object of an embodiment of the present invention is to provide an inductive antenna which overcomes all or part of the disadvantages of conventional antennas.

Another object of an embodiment of the present invention is to provide an antenna which is particularly well adapted to transmissions in a frequency range from one MHz to some hundred MHz.

Another object of an embodiment of the present invention is to provide a large inductive antenna (inscribing within a surface area at least ten times as large) as compared with the antennas of transponders with which it is intended to cooperate.

Another object of an embodiment of the present invention is to provide an antenna structure compatible with various layouts.

To achieve all or part of these and other objects, the present invention provides an inductive antenna formed of at least two pairs of geometrically butted sections, each comprising first and second parallel conductive elements insulated from each other, each pair comprising at each end a single terminal of electric connection of its first conductive element to that of the adjacent pair, wherein said pairs are:

of a first type where the conductive elements are interrupted approximately in their middle to define the two sections, the first, respectively the second, conductive element of a section being connected to the second, respectively the first, conductive element of the other section of the pair; or of a second type where the first conductive element is interrupted approximately in its middle to define the two sections, and the second conductive element is not interrupted.

According to an embodiment of the present invention, the conductive sections are longilineal, the antenna forming a loop having any type of geometry in space.

According to an embodiment of the present invention, the respective lengths of the conductive elements are selected according to the resonance frequency of the antenna.

According to an embodiment of the present invention, the respective lengths of the conductive elements are selected according to the line capacitance between the first and second conductive elements.

According to an embodiment of the present invention, at least one capacitive element interconnects the second conductive elements of adjacent pairs or the first and second conductive elements of a same pair.

According to an embodiment of the present invention, at least one resistive element interconnects the second conductive elements of adjacent pairs or the first and second conductive elements of a same pair.

According to an embodiment of the present invention, each section is a coaxial cable section.

According to an embodiment of the present invention, the sections are formed of twisted conductive elements.

The present invention also provides a system for generating a high-frequency field, comprising:

an inductive antenna; and a circuit for exciting the antenna with a high-frequency signal.

According to an embodiment of the present invention, said excitation circuit comprises a high-frequency transformer having a secondary winding interposed between the first conductive elements of two adjacent pairs of the antenna.

BRIEF DESCRIPTION OF THE DRAWINGS

The foregoing and other objects, features and advantages of the present invention will be discussed in detail in the following non-limiting description of specific embodiments in connection with the accompanying drawings, among which.

DETAILED DESCRIPTION

Figure 1:
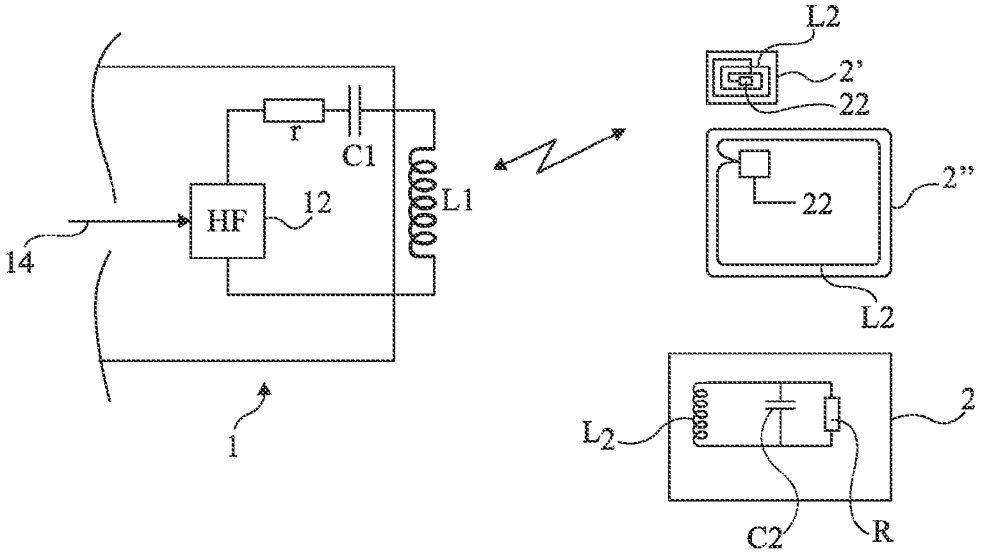
FIG. 1, previously described, schematically shows in the form of blocks an example of a radio frequency transmission system to which the present invention applies.

The same elements have been designated with the same reference numerals in the different drawings, which have been drawn out of scale. For clarity, only those elements which are useful to the understanding of the present invention have been shown and will be described. In particular, the excitation circuits of an inductive antenna have not been detailed, the invention being compatible with excitation signals currently used for this type of antenna. Further, the transponders for which the field generation antennas which are about to be described are intended have not been detailed either, the invention being compatible with the various current transponders, contactless cards, RFID tags, etc.

Figure 2:
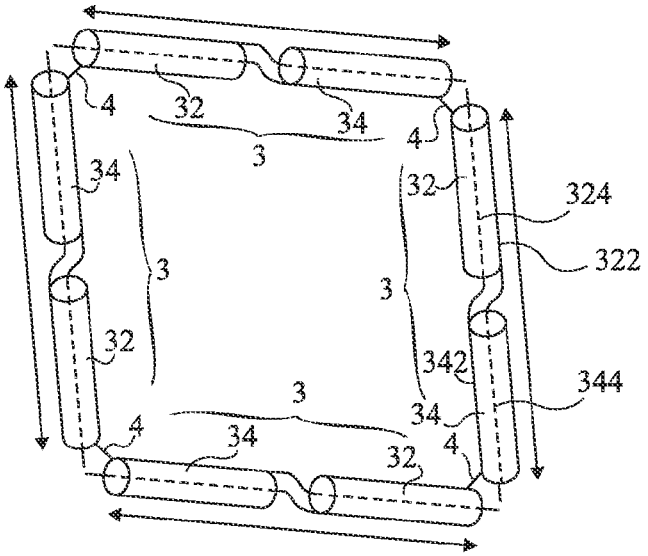
FIG. 2 is a simplified representation of an embodiment of an inductive antenna according to the invention.

FIG. 2 is a simplified view of an antenna according to an embodiment of the present invention.

In this embodiment, it is provided to butt several coaxial cable sections 32 and 34. These sections are gathered in pairs 3 in each of which the two sections 32 and 34 are connected in a Moebius-type connection, that is, core 324 of a first section is connected to braid 342 of the second section in the pair, while its braid 322 is connected to core 344 of this second section.

In the preferred example of FIG. 2, four pairs 3 of sections are butted. Electric connection 4 between two adjacent pairs is only provided by a single one of the conductive elements. In the example of FIG. 2, connection 4 between two adjacent pairs is provided by the respective braids of the opposite sections of the two pairs. The other conductive element is unconnected, that is, in the example of FIG. 2, the cores of two adjacent pairs are not connected.

It seems simpler to make a uniform choice for all sections so that all first conductors correspond either to the braid, or to the core of all sections. In this context, the conductive element of same type, braid or core, will be used to connect the pairs of the entire antenna. The braid is preferred since choosing it provides a better electric shielding. As a variation, it may be provided for connections 4 to be provided by the respective cores of the opposite pairs. It however remains possible to make a different choice of assignment of the first conductor and of the second conductor between the first section and the second section of a same pair, for example, to choose the braid as first conductor for the first section and the core as first conductor for the second section. Thus, according to another variation, it may be provided for connections 4 between two adjacent pairs to be performed from core to braid or conversely.

Figure 3:
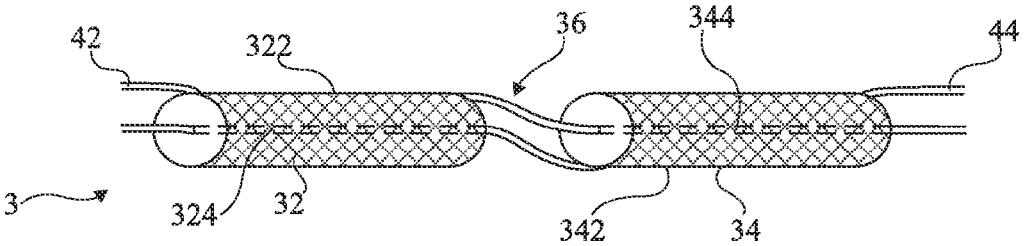
FIG. 3 shows an embodiment of a pair of sections of a first type of the antenna of FIG. 2.

FIG. 3 is a simplified representation of a pair 3 of two sections 32 and 34 of the antenna of FIG. 2, corresponding to a first type of pair of sections. At the level of central connection 36, conductive core 324 of section 32 is connected to braid (or shielding) 342 of section 34, and braid 322 of section 32 is connected to core 344 of section 34.

Figure 4:
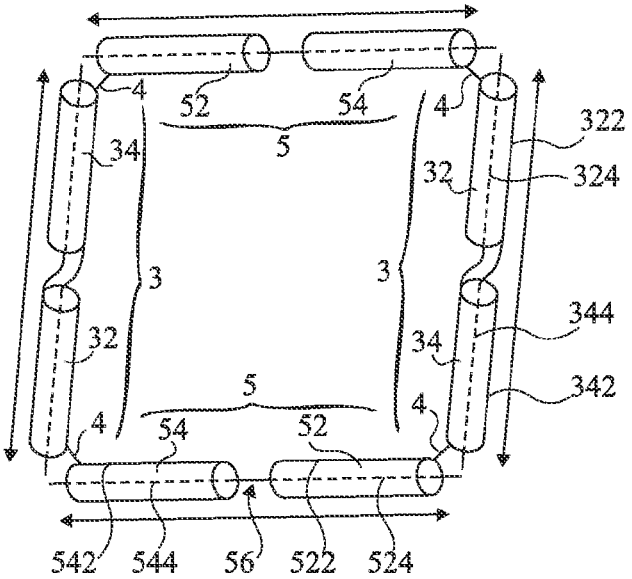
FIG. 4 is a simplified representation of another embodiment of an inductive antenna according to the invention.

FIG. 4 is a simplified representation of another embodiment of an antenna.

Two pairs 3 of sections 32 and 34 of the first type (with a crossed central connection—FIG. 3) are alternately connected to two pairs 5 of coaxial cable sections 52 and 54 where central connection 56 of the sections is different. In these pairs 5 of a second type, sections 52 and 54 are connected by their respective cores 524 and 544 while their braids 522 and 542 are not connected. The electric butt connections of the pairs are still achieved via an interconnection 4 of the braids while the cores are not connected.

The distribution and the number of pairs of the two types may vary. However, pairs of the first type are more advantageous.

Indeed, a pair of the first type provides an exposed area at the crossing, which decreases the circuit sensitivity to parasitic disturbances. Further, for a same resonance frequency, the pairs of sections may have a length twice smaller than for a pair of the second type. The length decrease makes the antenna forming easier. The value of inductance L0 associated with a pair of the first type can then be twice smaller than that associated with a pair of the second type. For a same circulation current, the electric voltage present between the first conductors in connection area 36 of the two sections of a pair of the first type is then twice smaller than the electric voltage in connection area 56 of a pair of the second type. The connection area within a pair is an exposed area which all the more conditions the circuit sensitivity to parasitic disturbances as the electric voltage is high in this area. The decrease of the electric voltage in this area introduced by the pair of the first type enables to decrease the sensitivity to disturbances.

Figure 5:
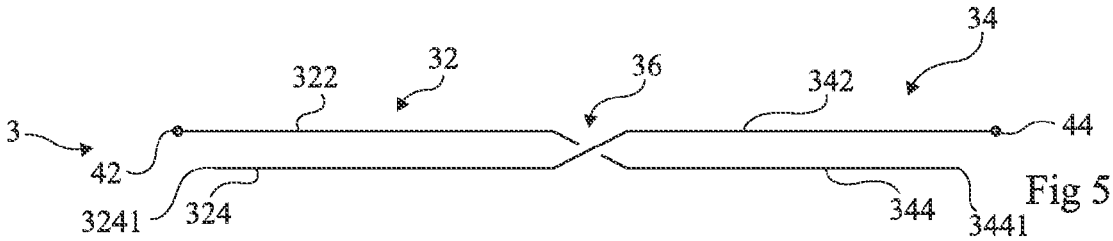
FIG. 5 shows the electric layout of an embodiment of a first type of pair of antenna sections.

FIG. 5 shows the electric layout of the first type of pair 3 of sections.

Figure 5A:
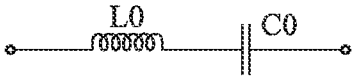
FIG. 5A shows the equivalent electric diagram of the pair of FIG. 5.

FIG. 5A shows the equivalent electric diagram of the pair of FIG. 5.

A pair 3 of sections 32 and 34 comprises two terminals and 44 of connection to adjacent pairs. Terminal 42 is connected to a first conductive element 322 of section 32 which, by its other end, is connected via crossed interconnect 36 to a second conductive element 344 of section 34 having an unconnected free end 3441 (on the side of terminal 44). Second conductive element 324 of section 32 has a free end 3241 (on the side of terminal 42) and its other end connected, by connection 36, to first conductive section 342 of section 34, having its other end connected to terminal 44.

The equivalent electric diagram of such a pair is shown in FIG. 5A and amounts to electrically arranging, in series, an inductance of value L0 and a capacitor of value C0, where L0 stands for the inductance corresponding to the association of conductor sections 322 and 342 considered as one and the same conductor for the calculation of this value, and where C0 stands for all internal capacitances, between core and braid in the case of a coaxial cable—between the two conductors (between conductors 322 and 324 and between conductors 342 and 344) in the case of the other embodiments. In the foregoing, the mutual inductances between the association of sections 322 and 342 (considered as a conductor for the calculation) and the associations of sections equivalent to sections 322 and 342 of the other pairs (also considered as a conductor for the calculation) is neglected. Due to forming in loops, the different pairs are sufficiently distant from one another to be able to neglect the mutual inductances with respect to the value of L0 such as considered hereabove.

Neglecting ohmic losses in the conductors and dielectric losses between conductors, the impedance of a pair of sections may, in this embodiment, be written as $Z=jL0\omega+1/jC0\omega$.

Figure 6:
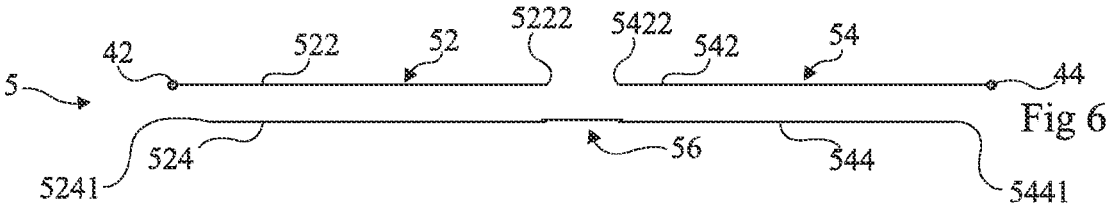
FIG. 6 shows the electric layout of an embodiment of a second type of pair of antenna sections.

FIG. 6 shows the electric layout of the second type of pair 5 of sections.

Figure 6A:
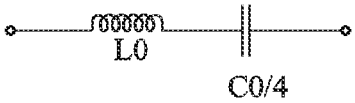
FIG. 6A shows the equivalent electric diagram of the pair of FIG. 6.

FIG. 6A shows the equivalent electric diagram of the pair of FIG. 6.

In a pair 5 of sections 52 and 54, a first conductor 522 of a first section 52 is connected to a first access terminal 42 and its other end 5222 is left floating (unconnected). A first conductive element 542 of a second section 54 is, on the side of section 52, left floating (end 5422) and, at its other end, connected to terminal 44 of access to pair 5. Second conductor 524 of first section 52 is connected, by interconnect 56, to second conductor 544 of second section 54. Ends 5241 and 5441 of sections 524 and 544 are left floating.

From an electric point of view and as illustrated in FIG. 6A, assuming that the conductors of pairs 3 and 5 have the same length, pair 5 amounts to a series connection of an inductive element of value L0 with a capacitive element of value C0/4, where L0 stands for the inductance corresponding to the association of conductor sections 522 and 542 and C0 amounts for all the internal capacitances (between conductors 522 and 524 and between conductors 542 and 544).

The impedance of a pair of sections in this embodiment is $Z=jL0\omega+1/j(C0/4)\omega$.

From an electric viewpoint, two pairs of sections 3 in series are equivalent to one pair of sections 5 of double length.

The lengths will be adapted to the operating frequency of the antenna so that each pair of sections respects the tuning, that is, $LC\omega^2=1$. It can be seen that, according to the distribution of the types of pairs between pairs 3 and 5, the lengths of the conductive elements and the line capacitance value between the two section conductors can be varied. The values of the capacitive elements are now no longer negligible and the antenna is less sensitive to disturbances of its environment.

Forming an antenna with several pairs of sections of the type in FIGS. 5 and 6 enables to split the electric circuit and avoids too long inductive elements where the current flowing along the inductive loop circuit would not be able to have a homogeneous amplitude and phase all along the circuit. Indeed, the interconnection of the pairs amounts to series-connecting several resonant circuits of same resonance frequency. The length of the inductive antennas is then no longer limited.

The different pairs of sections do not necessarily have the same lengths, provided for each pair to respect, possibly with an interposed capacitor connected between two conductors at the level of a junction between pairs, the resonance relation.

Figure 7:
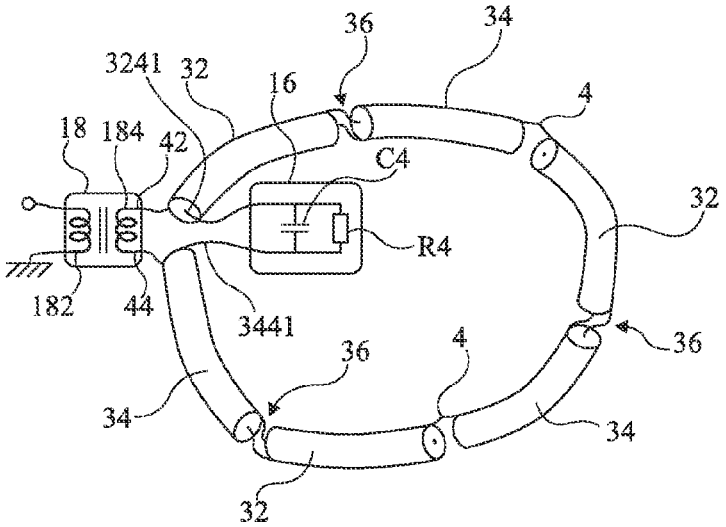
FIG. 7 shows an embodiment of an inductive antenna and of excitation and setting circuits.

FIG. 7 shows an embodiment of an inductive antenna and of excitation and setting circuits. The antenna here comprises three pairs 3 of the first type.

Excitation circuit 18 is a high-frequency transformer having its primary 182 receiving a signal of excitation of the high-frequency generator 12 (FIG. 1) and having the two terminals of its secondary 184 connected to terminals 42 and 44 of two adjacent pairs instead of their interconnection 4. The secondary winding thus forms this connection between the two pairs. The transformer will preferably be selected to take back to the secondary side an inductance that is negligible at the operating frequency with respect to value L0, which for example occurs when the coupling is close to 1.

Further, a setting circuit 16 connects free ends 3241 and 3441 of conductors 324 and 344 of these two pairs, which are thus connected. Circuit 16 is, in the example of FIG. 7, a resistive (resistor R4) and capacitive (capacitor C4) circuit. The function of capacitor C4 is to adjust the resonance frequency of the antenna. The function of resistor R4 is to set quality factor Q of the antenna to a selected value, for example, to adjust the bandwidth.

Capacitors may be interposed between different pairs, connected between conductive elements of a same section, between conductive elements left free (here, the coaxial section cores) and connection point 42 or 44 (here, the braids of the coaxial sections), or between the conductors left free of the interconnected sections of each pair, to decrease the resonance frequency.

The length of conductive element 324 or 344 left free (here, the cores) may also be decreased to decrease the total capacitance of the corresponding section to increase the resonance frequency.

Similarly, resistive elements may be connected between the free ends of the conductive elements between two pairs to adjust and decrease the quality factor of the antenna thus formed. Resistive elements may also be inserted instead of an interconnect 4 between two pairs to decrease and adjust the quality factor.

The shape to be given to the different sections is not necessarily rectilinear. As illustrated in FIG. 7, the sections may follow various layouts. Thus, the closed antenna of the invention may follow the pattern of a frame, make loops, have a rounded shape, follow shapes in the three dimensions of space, etc.

In the above embodiments, the adjustment circuits have been illustrated with a connection between pairs. It should be noted that as a variation and in the case of pairs of the second type (5), such circuits may be inserted within the very pairs of sections. In this case, a capacitor which would be introduced connects the two non-interconnected free ends of elements 522 and 542.

Resistive elements may also be inserted instead of the connections between conductors of the two sections of a same pair (of the first type 3 and of the second type 5) at junction 36 and 56 to decrease the quality factor.

Figure 8A:
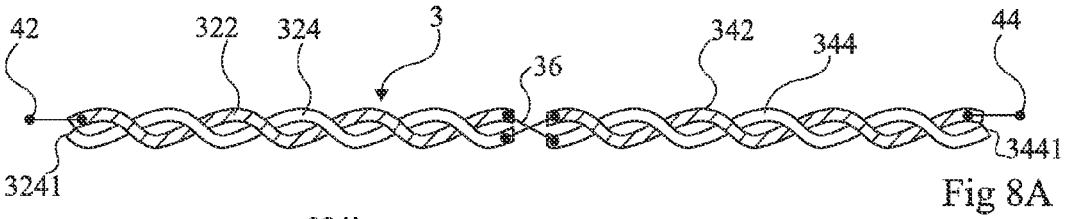
FIGS. 8A and 8B show two other embodiments of a pair of sections of the first type.
Figure 8B:
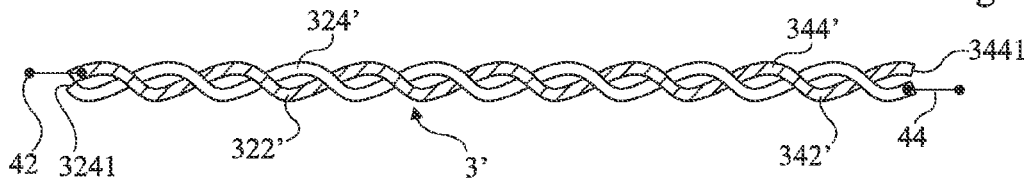
Figure 9:
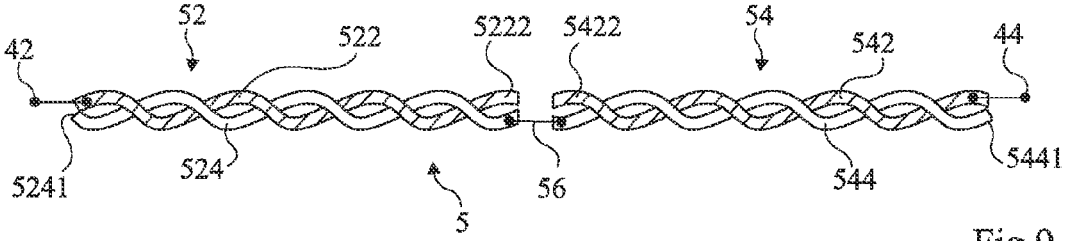
FIG. 9 shows another embodiment of a pair of sections of the second type.

FIGS. 8A, 8B, and 9 show pairs of conductive sections according to another embodiment of the present invention. This embodiment illustrates that pairs of conductive sections may be formed by means of twisted conductors rather than by means of coaxial sections.

FIGS. 8A and 8B show two embodiments of a pair 3 of sections of the first type.

In FIG. 8A, two twisted wire sections are interconnected in a way similar to that described in relation with coaxial cable sections.

FIG. 8B shows another embodiment of a cross interconnection pair of sections where the crossing is actually obtained by inverting the conductor having the output terminal (for example, 44) connected thereto with respect to that having the input terminal (for example, 42) connected thereto, and the conductive sections are not interrupted inside the pair.

FIG. 9 shows an embodiment of a pair 5 of sections 52 and 54 of the second type, formed of twisted conductors.

According to still another embodiment, not shown, the pairs of sections are formed with non-twisted conductors, shielded or not.

According to still another embodiment, not shown, the pairs of sections are formed by tracks deposited on an insulating substrate.

An antenna such as defined hereabove may also be defined as comprising at least two geometrically butted longilineal subassemblies (3, 5, 3'), each comprising, according to their length, a first and a second parallel conductive elements insulated from each other, and at each end, in connection with the first conductive element, a single terminal of electric connection to the adjacent subassembly, and the second conductor is not electrically connected, where all or part of the subassemblies are:

of a first type where each of the first and second conductors is interrupted approximately in its middle and reconnected to the other conductor of the subassembly; or of a second type where the first conductor is interrupted approximately in its middle, and the second conductor is not interrupted.

With such a definition, a conductive element is, in the case of a cross connection (FIGS. 3, 5, and 8A) formed of two portions, electrically in series, of conductive wires (core or braid) different from the cable used so that each connection terminal is connected to the conductor of same nature (braid or core) of the subassembly while it is not electrically connected to the other terminal.

As a specific embodiment, sections may be formed by cutting usual coaxial lines. There currently exist some with characteristic impedances of 50, 75, and 93 ohms, having respective line capacitance values of 100 pF/m, 60 pF/m, and 45 pF/m. For example, with a 50-ohm coaxial cable, inductances L0 on the order of one μH can be obtained in the case of a cross connection.

According to another specific embodiment using sheathed conductors (twisted or not), the cables have a line capacitance between conductors approximately ranging from 30 to 40 pF/m. With such cables, inductances L0 having a value ranging between approximately 2 and 3 μH may for example be obtained.

Figure 10:
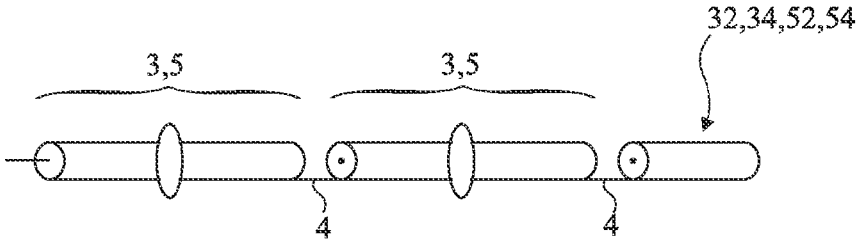
FIG. 10 is a simplified representation of an antenna according to another embodiment.

FIG. 10 is a simplified representation of an antenna according to another embodiment. As in the other embodiments, the antenna comprises at least two pairs (of the first type 3, FIG. 5 or of the second type 5, FIG. 6) of sections, each formed of parallel conductive elements insulated from each other. In the example of FIG. 10, pairs of coaxial cable sections are assumed. This structure is completed with an additional half-pair formed of two conductive elements of the first type 32, 34 or of the second type 52, 54. Instead of being at the end of the antenna, the half-pair may possibly be interposed between two pairs. The presence of the additional half-pair may be used to adjust the antenna length.

Figure 11:
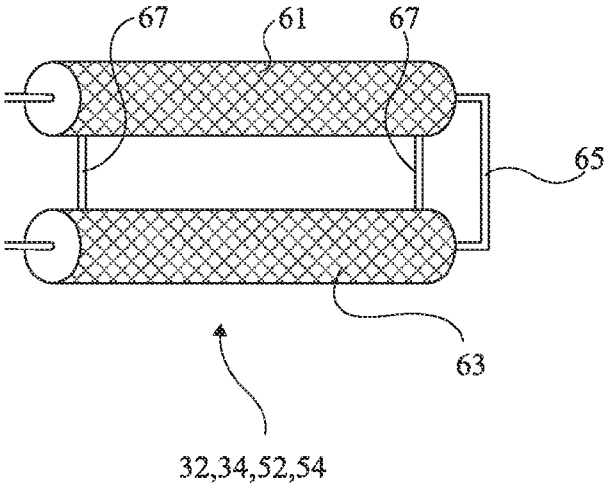
FIG. 11 is a simplified representation of a variation a conductive element which can form a section of the antenna.

FIG. 11 is a simplified representation of a variation according to which two coaxial cable segments 61 and 63 are mechanically arranged side by side in parallel and their braids are electrically connected to each other, at least at the two ends to form a single first conductive element (connection 67). The cores are electrically connected to form a single second conductive element (connection 65 at one of the ends). Each element of the type illustrated in FIG. 11 forms a section 32, 34, 52, or 54 of the antenna structure. An advantage of the section formed by the assembly of segments of FIG. 11 is to increase the line capacitance of the section, between the first conductive element and the second conductive element. This enables to decrease the necessary length of a pair for a same resonance frequency and thus to have more flexibility as to the antenna geometry.

In the forming of antennas with coaxial sections, more advantage is taken of the capacitance between the shielding and the conductive core to form inductive and capacitive sections, having a greater capacitance (and thus that may be shorter for a same frequency) than in a wire element.

An advantage of the described embodiments is that they enable to form antennas of large dimensions for applications to resonance frequencies greater than one MHz (typically between 10 and 100 MHz). Antennas can thus be created on portals, counters, etc. while having a homogeneous current circulation along the loop to generate the desired field.

As a specific embodiment, an antenna adapted to an operation at a 13.56-MHz frequency may be made in the form of a rectangular loop of approximately 87 cm by 75 cm formed of three pairs of conductors (three times two sections) of the first type in 50-ohm, 100-pF/m coaxial cable (3.5 mm braid diameter), distributed in two pairs following a L layout of 1.07-m developed length (with an inductance L0 of approximately 1.22 μH or 1.21 μH, taking the mutual inductance into account) and one pair following a U layout of 1.08 m developed length (with an inductance L0 of approximately 1.20 μH or 1.19 μH, taking mutual inductances into account). The resonance frequency may be adjusted by a variable capacitor.

Various embodiments have been described, various alterations and modifications will occur to those skilled in the art. In particular, the dimensions to be given to the conductive sections and to the capacitive elements depend on the application and their calculation is within the abilities of those skilled in the art based on the functional indications given hereabove and on the desired resonance frequency and antenna size.

The invention claimed is:

1. An inductive antenna comprising at least two pairs of geometrically butted sections, each section comprising first and second conductive elements insulated from each other and parallel to each other, each of said pairs comprising two ends and at each said end a single terminal of electric connection of its first conductive element to one of the single terminals of an adjacent pair, its second conductive element having a free end and not being connected to either of the single terminals of said adjacent pair, wherein said pairs are:

of a first type where the first and second conductive elements of one section are connected to the second and first conductive elements respectively of the other section of the pair; or of a second type where the first conductive element of one section is not connected to the first conductive element of the other section and the second conductive element of the one section is connected to the second conductive element of the other section.

2. The antenna of claim 1, wherein the conductive sections are longilineal, the antenna forming a loop having any type of geometry in space.

3. The antenna of claim 1, wherein the respective lengths of the conductive elements are selected according to the resonance frequency of the antenna.

4. The antenna of claim 1, wherein the respective lengths of the conductive elements are selected according to the line capacitance between the first and second conductive elements.

5. The antenna of claim 1, wherein at least one capacitive element interconnects the second conductive elements of adjacent pairs or the first and second conductive elements of a same pair.

6. The antenna of claim 1, wherein at least one resistive element interconnects the second conductive elements of adjacent pairs or the first and second conductive elements of a same pair.

7. The antenna of claim 1, wherein each section is a coaxial cable section.

8. The antenna of claim 1, wherein each section is formed of two coaxial cable segments.

9. The antenna of claim 1, wherein the sections are formed of twisted conductive elements.

10. The antenna of claim 1, further comprising a half-pair formed of a section of two conductive elements coupled to at least one pair.

11. A system for generating a high-frequency field, comprising:

the inductive antenna of claim 1; and a circuit for exciting the antenna with a high-frequency signal.

12. The system of claim 11, wherein said excitation circuit comprises a high-frequency transformer having a secondary winding interposed between the first conductive elements of two adjacent pairs of the antenna.

13. An inductive antenna comprising:

at least two pairs of geometrically butted sections forming a loop, each of said sections comprising parallel first and second conductive elements insulated from each other, each of said first conductive elements including a terminal of electric connection with an adjacent one of the pairs, and each of said second conductive elements including a free end, wherein the first conductive element of a first section of each of the pairs is connected to the second conductive element of a second section of the pair and the first conductive element of the second section of the pair is connected to the second conductive element of the first section of the pair.

14. An inductive antenna comprising:

at least two pairs of geometrically butted sections forming a loop, each of said sections comprising parallel first and second conductive elements insulated from each other, each of said first conductive elements including a terminal for electric connection with an adjacent one of the pairs, and each of said second conductive elements including a free end, wherein each of the first conductive elements of each of the pairs includes a free end and the second conductive element of a first section of the pair is connected to the second conductive element of the second section of the pair.

* * * * *